US006874164B2

(12) United States Patent
Droppo et al.

(10) Patent No.: US 6,874,164 B2
(45) Date of Patent: Apr. 5, 2005

(54) EXPANDABLE SHIRT COLLAR

(75) Inventors: Rick Droppo, Cambridge (CA); Harris Hester, Darien, CT (US)

(73) Assignee: Forsyth of Canada, Inc., Mississuaga (CA)

( * ) Notice: Subject to any disclaimer, the term of this patent is extended or adjusted under 35 U.S.C. 154(b) by 0 days.

(21) Appl. No.: 10/390,834

(22) Filed: Mar. 18, 2003

(65) Prior Publication Data

US 2004/0181845 A1 Sep. 23, 2004

(51) Int. Cl.[7] ..... A41B 3/02
(52) U.S. Cl. ..... 2/141.2; 2/129
(58) Field of Search ..... 2/140, 142, 143, 2/141.1, 141.2, 76, 77, 106, 113–116, 121–123, 127–136, 139, 219–221, 235–237

(56) References Cited

U.S. PATENT DOCUMENTS

| | | | | | |
|---|---|---|---|---|---|
| 418,639 | A | * | 12/1889 | Batter | 2/127 |
| 1,086,451 | A | * | 2/1914 | Glasgow | 2/127 |
| 1,280,673 | A | * | 10/1918 | Cree | 2/141.2 |
| 1,280,742 | A | * | 10/1918 | Hurd | 2/131 |
| 1,963,004 | A | | 6/1934 | Tucker | |
| 2,025,485 | A | | 12/1935 | Tucker | |
| 2,385,638 | A | * | 9/1945 | Doak | 2/116 |
| 2,418,772 | A | * | 4/1947 | Jackson | 2/235 |
| 2,585,689 | A | * | 2/1952 | Schafer | 2/127 |
| 2,911,650 | A | * | 11/1959 | Gerich | 2/74 |
| 2,996,723 | A | | 8/1961 | Ainslie | |
| 3,042,932 | A | * | 7/1962 | Eppy | 2/236 |
| 3,066,307 | A | * | 12/1962 | Loewe | 2/74 |
| 3,828,365 | A | | 8/1974 | Berger | 2/128 |
| 4,000,522 | A | * | 1/1977 | Swanson | 2/116 |
| 4,193,136 | A | * | 3/1980 | Pierce | 2/237 |
| 4,580,298 | A | * | 4/1986 | Tuisl | 2/237 |
| 4,648,137 | A | * | 3/1987 | Cooper | 2/116 |
| 4,825,472 | A | * | 5/1989 | Garafano | 2/116 |
| 4,937,884 | A | | 7/1990 | Sherman | 2/129 |
| 4,947,489 | A | * | 8/1990 | Greenwood | 2/304 |
| 5,274,853 | A | | 1/1994 | Millican | 2/141.2 |
| 5,692,240 | A | | 12/1997 | Steele | 2/129 |
| 5,898,941 | A | | 5/1999 | Groshens | 2/129 |
| 6,081,926 | A | | 7/2000 | Krause et al. | 2/129 |
| 6,085,356 | A | * | 7/2000 | Redmond, Sr. | 2/237 |
| 6,164,227 | A | | 12/2000 | Itoh | 112/475.06 |
| 6,212,686 | B1 | | 4/2001 | Krause et al. | 2/129 |
| 6,434,802 | B1 | * | 8/2002 | Pannone | 24/306 |
| 6,449,775 | B1 | * | 9/2002 | Battaglia | 2/312 |
| 6,477,713 | B2 | | 11/2002 | Krause et al. | 2/129 |
| 6,715,155 | B2 | * | 4/2004 | Duflos | 2/237 |
| 2001/0003850 | A1 | | 6/2001 | Krause et al. | 2/129 |
| 2002/0120974 | A1 | | 9/2002 | Krause et al. | 2/129 |

FOREIGN PATENT DOCUMENTS

| | | | | |
|---|---|---|---|---|
| FR | 680742 | | 5/1930 | |
| GB | 2242816 A | * | 10/1991 | A41B/3/02 |
| JP | 5-132801 | | 5/1993 | A41B/1/16 |
| JP | 9-031701 | | 2/1997 | A41B/3/00 |
| WO | WO 02/065864 | | 8/2002 | |

* cited by examiner

*Primary Examiner*—Alissa L. Hoey
(74) *Attorney, Agent, or Firm*—Hayes Soloway PC; Peter A. Nieves

(57) ABSTRACT

An apparatus for increasing the comfort and flexibility of a shirt collar has an extender tab that is coupled to a collar band with an elastic material that can expand to compensate for shrinkage of the collar due to laundering or an increase in the neck size of the wearer.

30 Claims, 5 Drawing Sheets

EXPANDABLE SHIRT COLLAR

FIELD OF THE INVENTION

The present invention relates generally to garments and more particularly to a shirt having an expandable collar to increase comfort and flexibility.

BACKGROUND OF THE INVENTION

Shirts, such as dress shirts, are typically purchased based on neck size and arm length of the intended wearer. Comfort associated with the purchased dress shirt is usually provided by a loose fitting neck portion, otherwise referred to as a collar band. Generally, the collar band is not elastic. A reduction in length of the collar band due to laundering or an increase in the size of the neck of the wearer can cause discomfort to the wearer when the top button of the shirt is buttoned.

Shirt manufacturers have attempted to resolve this problem by making non-shrink collar bands or shirts with exposed elastic material, either in the front of the collar band, or along the rear of the collar band. A disadvantage of non-shrink collars is that the shirt is made to accommodate one neck size. In addition, a disadvantage of exposed elastic material in the front or the rear of the collar band is that the elastic material detracts from the aesthetic appeal of the shirt.

Shirts, in particular dress shirts, in addition to other articles of clothing, are manufactured in standard collar sizes, wherein the collar fastens with a stationary button. Collar sizes are typically manufactured in half-inch increments. A drawback to shirts being manufactured in half-inch increments is that a shirt manufacturer is required to produce shirts having different neck sizes for the same sleeve length. For example, a shirt having a 33" sleeve is produced in 15½", 16" and 16½" neck sizes.

SUMMARY OF THE INVENTION

Briefly described, the invention provides an expandable collar.

In architecture, one embodiment of the apparatus, among others, can be implemented as follows. An expandable shirt collar has a collar band with a first end portion and a second end portion. A button hole extends through the second end portion of the collar band. A tab having a first end portion and a second end portion is provided, wherein a button is secured to the second end portion of the tab. An elastic material having a first end and a second end is provided, wherein the first end of the elastic material is coupled to the first end portion of the collar band and the second end of the elastic material is coupled to the first end portion of the tab.

Other apparatus, features and advantages of the present invention will be or become apparent to one with skill in the art upon examination of the following drawings and detailed description. It is intended that all such additional apparatus features and advantages be included within this description, be within the scope of the present invention, and be protected by the accompanying claims.

BRIEF DESCRIPTION OF THE DRAWINGS

The present invention will be more fully understood from the detailed description given below and from the accompanying drawings of the embodiments of the invention, which however, should not be taken to limit the invention to the specific embodiments, but are for explanation and for better understanding. Furthermore, the drawings are not necessarily to scale, emphasis instead being placed upon clearly illustrating the principles of the invention. Finally, like reference numerals in the figures designate corresponding parts throughout the several drawings.

DETAILED DESCRIPTION OF THE DRAWINGS

Figure 1:
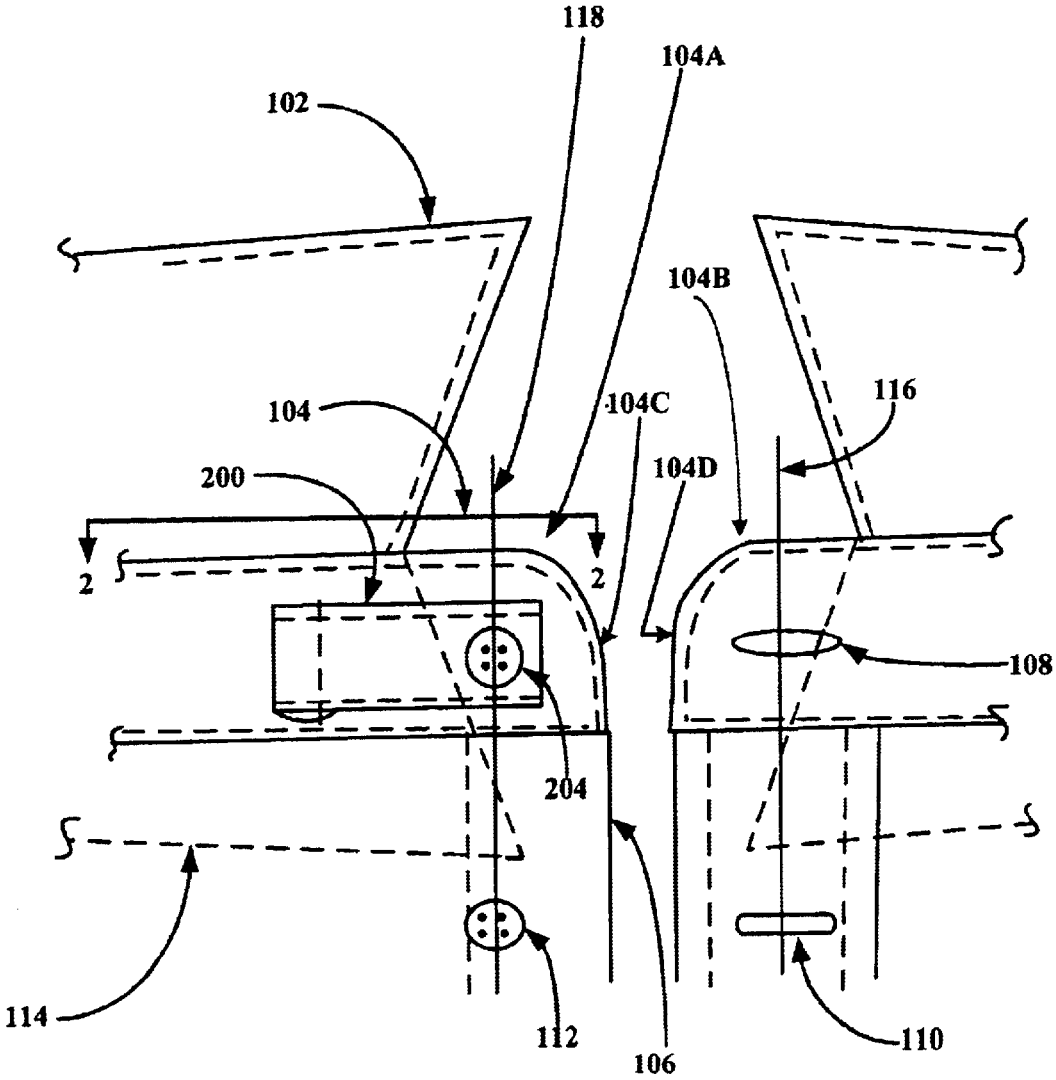
FIG. 1 is a partial front view of a garment having an expander tab assembly in accordance with a first exemplary embodiment of the invention.
Figure 2:
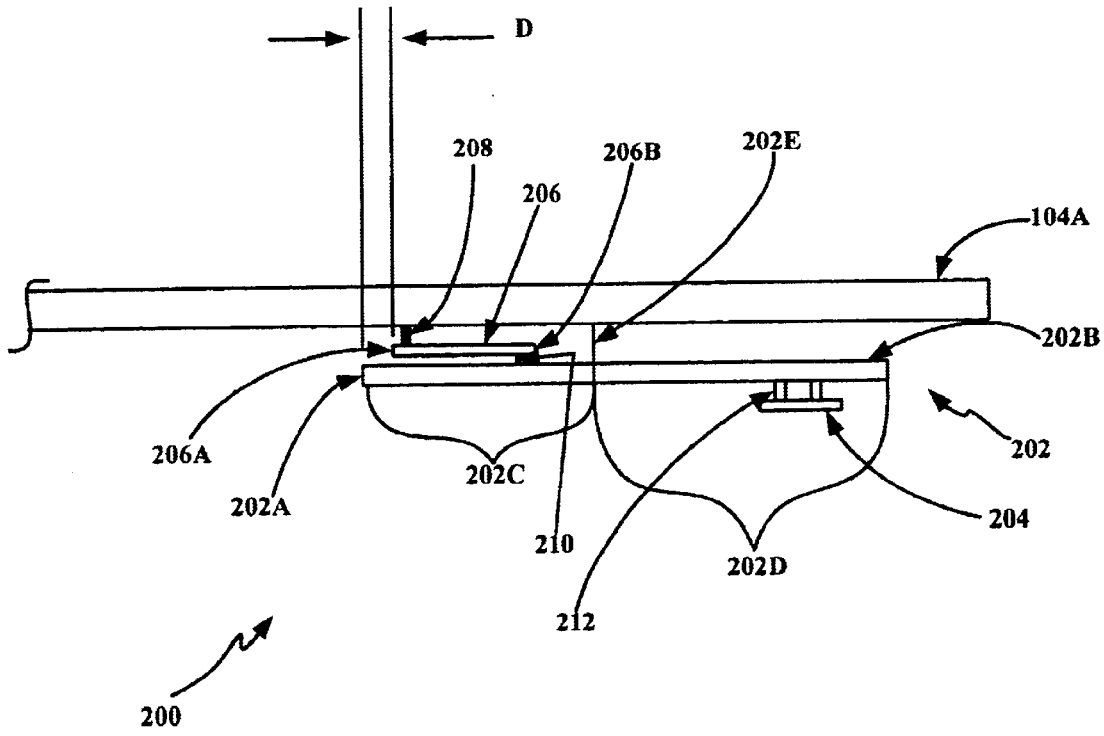
FIG. 2 is a top view of the garment of FIG. 1 taken through line 2—2.

FIGS. 1 and 2 illustrate a garment 100 having an expander tab assembly 200 in accordance with a first exemplary embodiment of the invention. The garment 100, shown as a dress shirt, includes a collar 102, a collar band 104, and a shirt body 106 joined in conventional fashion, such as, for example, via stitching. The expander tab assembly 200 may be coupled to the collar band 104. The collar 102 is shown with solid lines in the "up" position and with hidden lines in the "down" position. It should be noted that a different dress shirt may have buttons and button holes on opposite sides than shown in FIG. 1.

Figure 6:
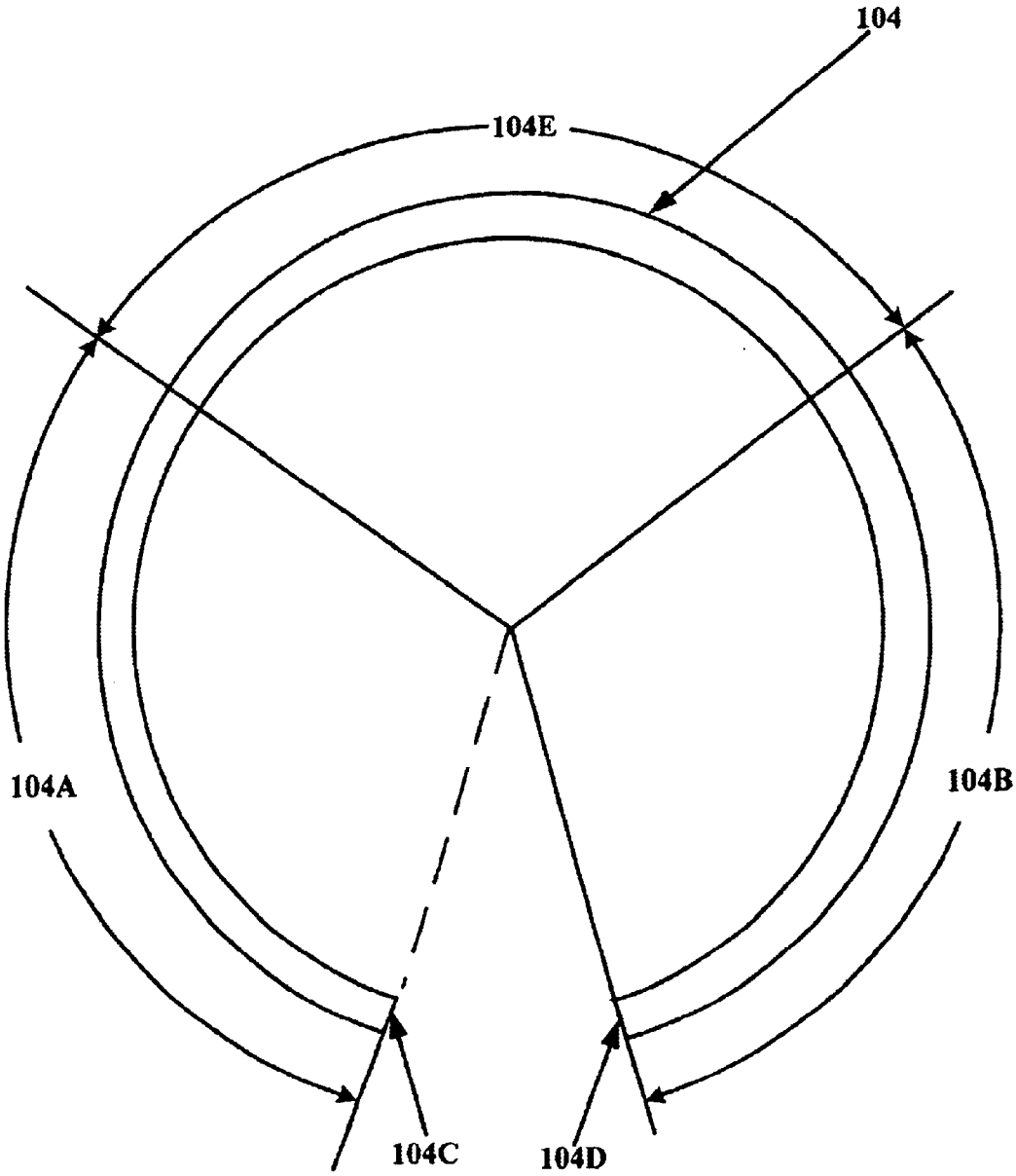
FIG. 6 is a top view of a collar band of the garment of FIG. 1.

As shown in FIG. 6, the collar band 104, which may be made as one piece, has a first end portion 104A, a middle portion 104E, and a second end portion 104B. The first end portion 104A being defined as the first approximately ⅓ of the length of the collar band 104 extending a first collar end 104C towards the middle portion 104E, the second end portion 104B being defined as the last approximately ⅓ of the length of the collar band 104 extending from the middle portion 104E towards a second collar end 104D, and the middle portion 104E being defined as the middle approximately ⅓ of the length of the collar band 104 between the first end portion 104A and the second end portion 104B.

Returning to FIG. 1, a collar button hole 108, preferably of conventional size, may be formed in, and extend through, the second end portion 104B of the collar band 104. The collar button hole 108 may be aligned with a shirt body button hole 110 on the shirt body 106, along a button hole axis 116. A shirt body button 112 may be coupled to the shirt body 106 along a button axis 118 in a conventional fashion. Alternatively, the shirt body button 112 and cooperating shirt body button hole 110 may be replaced with cooperating snaps, hooks, or other fastening means.

As is illustrated by FIG. 2, in addition to FIG. 1, the expander tab assembly 200 includes a generally rectangular tab 202, an elastic material 206, and a collar button 204. It should be noted that the expander tab assembly 200 need not be limited in shape to a generally rectangular tab 202, but instead may have a different shape such as, but not limited to, an oval or square shape. The expander tab assembly 200 is shown in FIGS. 1 and 2 with the elastic material 206 in a "relaxed" condition.

The tab 202 may be made of the same color material as the collar band 104 or of a contrasting material. The tab 202 may be made of a single layer of fabric or multiple layers of fabric. In accordance with the first exemplary embodiment of the invention, the tab 202 has a first end portion 202C and a second end portion 202D. The first end portion 202C of the tab 202 extends from a first end 202A to a mid point 202E of the tab 202. In addition, the second end portion 202D of the tab 202 extends from a second end 202B to the mid point 202E of the tab 202. The tab 202 is preferably coupled to the collar band 104 so that the first end 202A of the tab 202 is hidden under the collar when the collar 102 is in the down position.

The collar button 204 may be coupled to the second end portion 202D of the tab 202 with stitching 212, or via a different fastening means. The collar button 204 is preferably aligned with the button axis 118 when the elastic material 206 is in the "relaxed" condition.

The elastic material 206 couples the tab 202 to the collar band 104. It should be noted that an elastic material is any material that returns to, substantially returns to, or is capable of returning to or substantially returning to an initial form or state after deformation. The elastic material 206 may have a first end 206A and a second end 206B. The first end 206A of the elastic material 206 may be coupled to the collar band 104 with stitching 208 or a different fastening means. The second end 206B of the elastic material 206 may be coupled to the first end portion 202C of the tab 202 with stitching 210 or a different fastening means. To hide the elastic material 206, the first end 202A of the tab 202 may extend past the first end 206A of the elastic material 206 by a distance "D" when the elastic material 206 is in the "relaxed" condition. Preferably, the elastic material 206 may be stretched to two times its unstretched length without permanently deforming the elastic material. It should be noted that via use of different elastic materials, the amount of stretch may be more or less than the aforementioned amount. The spring constant (K) for the elastic material may be chosen to allow a predetermined stretch for a predetermined amount of tensile force applied. It is desirable that the length of elastic material be chosen to allow the collar to expand greater than a half inch and more preferably, greater than an inch.

Figure 3:
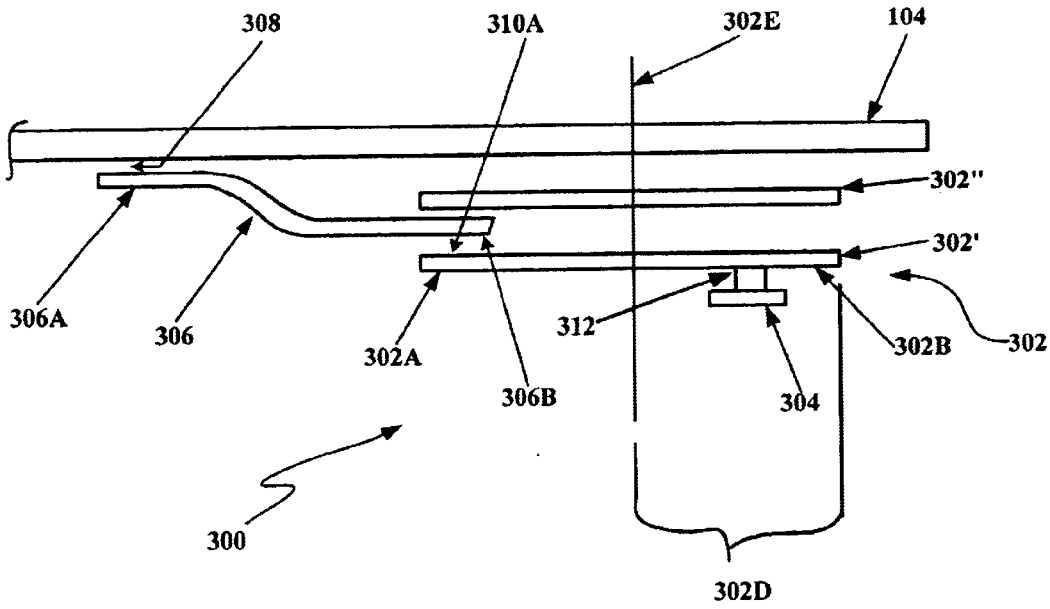
FIG. 3 is a top view of an expander tab assembly in accordance with a second exemplary embodiment of the invention.

FIG. 3 illustrates an expander tab assembly 300 in accordance with a second exemplary embodiment of the invention. The expander tab assembly 300 includes a generally rectangular tab 302, an elastic material 306, and a collar button 304. The expander tab assembly 300 is shown in FIG. 3 with the elastic material 306 in the "relaxed" condition. The tab 302 may have a first end 302A and a second end 302B. The tab 302 may be made of a first layer of material 302' and a second layer of material 302", the layers being coupled together, for example, via stitching. A first end 306A of the elastic material 306 may be coupled to the collar band 104 with stitching 308 or any other fastening means. A second end 306B of the elastic material 306 may be sandwiched between the first layer of material 302' and the second layer of material 302" at the first end 302A of the tab 302 and coupled together, for example, via stitching 31A. Alternatively, the second end 306B of the elastic material 306 may be sandwiched between the layers 302' and 302" of the tab 302 and coupled to the tab 302 anywhere along the length of the tab 302, for example via stitching.

The collar button 304 may be coupled to a second end portion 302D of the tab 302 with stitching 312 or any other fastening means. The second end portion 302D of the tab 302 is recognized as extending from the second end 302B of the tab 302 to a mid point 302E of the tab 302. The collar button 304 is preferably aligned with the button axis 118 (FIG. 1) when the elastic material 306 is in the "relaxed" condition.

In use, a wearer inserts the button 112 coupled to the shirt body 106 into the button hole 110. The user may also insert collar button 204/304, coupled to the tab 202/302, in the button hole 108 in the second end portion 104B of the collar band 104 as shown in FIGS. 1, 2, and 3.

It should be noted that an outwardly directed force applied to the collar band 104 may cause the elastic material 206/306 to stretch without permanently deforming.

Figure 4:
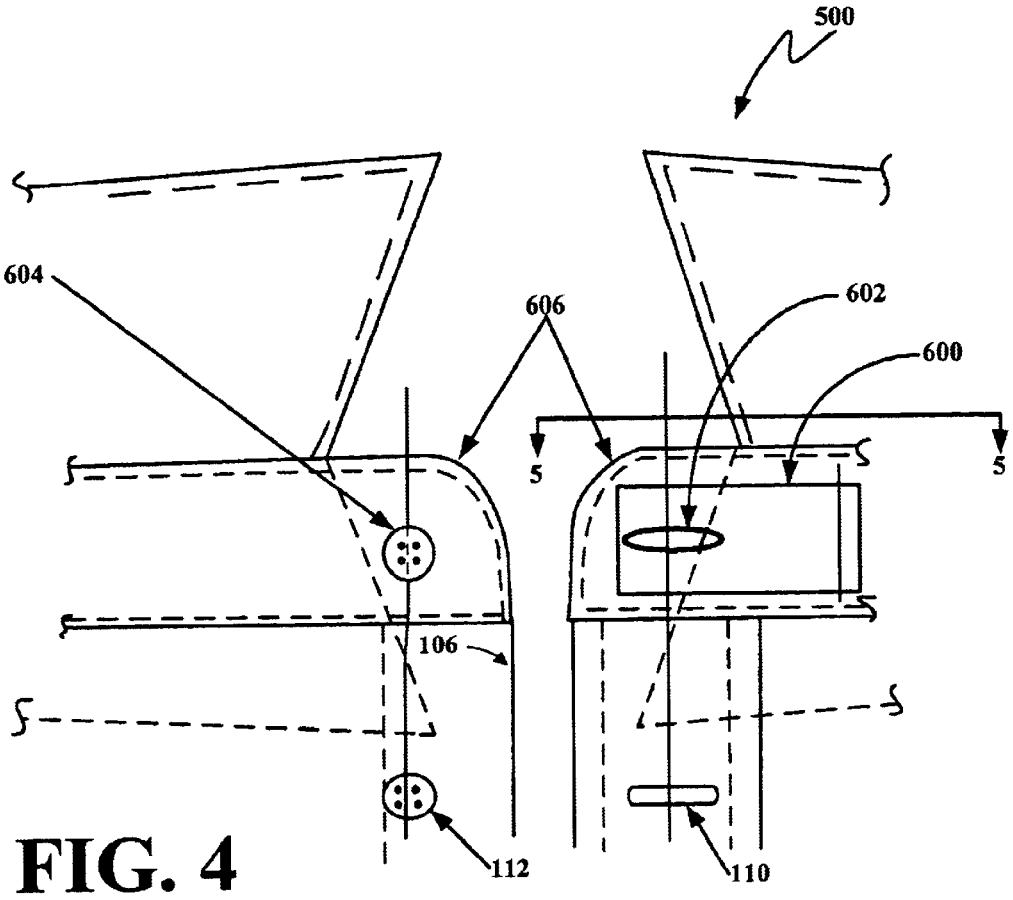
FIG. 4 is a partial front view of a garment having an expander tab assembly in accordance with a third exemplary embodiment of the invention.
Figure 5:
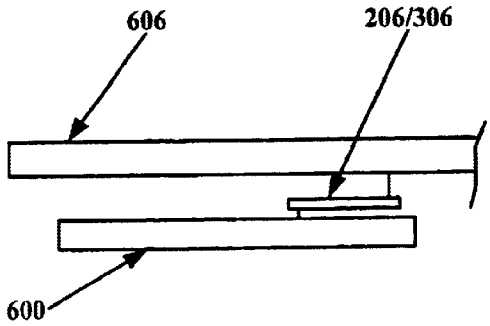
FIG. 5 is a top view of the garment of FIG. 4 taken through line 5—5.

FIGS. 4 and 5 illustrate a garment 500 having an expander tab assembly in accordance with a third exemplary embodiment of the invention. The garment 500 is similar to the garment 100 shown in FIG. 1, except an expander tab 600 has a button hole 602 and a cooperating button 604 is coupled to a collar band 606. The expander tab 600 may be coupled to the collar band 606 using an elastic material 206, 306, in a manner similar to that shown in FIG. 2 or FIG. 3.

In use, a wearer may insert the collar button 604, coupled to the collar band 606, into the button hole 602 located in the expander tab 600 as shown in FIG. 4. It should be noted that an outwardly directed force applied to the collar band 606 may cause the elastic material 206/306 to stretch without permanently deforming.

As shown above, the present invention allows the end portions 104A and 104B of the collar band 104 to separate via the expander tab assembly to compensate for shrinkage of the collar band due to laundering or for an increase in the neck size of the wearer.

The present invention may also enable a shirt manufacturer to manufacture a single shirt that can be worn by numerous wearers having differing neck dimensions. As an example, a shirt having one sleeve length (e.g., 33") may be worn by a user having a neck size of 15", 15½", and 16".

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

We claim:

1. An expandable shirt collar, comprising:

a collar band having a first end portion and a second end portion;

a button hole extending through the second end portion of the collar band;

a tab having a first end portion and a second end portion;

a button coupled to the second end portion of the tab wherein the button is vertically aligned with a linear array of buttons on the shirt body when an elastic material is in a relaxed condition; and the elastic material having a first end and a second end, the first end of the elastic material coupled to the first end portion of the collar band and the second end of the elastic material coupled to the first end portion of the tab.

2. The expandable shirt collar of claim 1, wherein a front surface of the tab and an outer surface of the collar band have an identical fabric.

3. The expandable shirt collar of claim 1, wherein a front surface of the tab and an outer surface of the collar band have a contrasting fabric.

4. The expandable shirt collar of claim 1, wherein the button is disposed on a front surface of the tab and the elastic material is disposed on a rear surface of the tab.

5. The expandable shirt collar of claim 1, wherein the button is disposed on a front surface of the tab and the elastic material is disposed between a front surface of the tab and a rear surface of the tab.

6. The expandable shirt collar of claim 1, wherein the collar band is disposed between a collar and a shirt body.

7. The expandable shirt collar of claim 1, wherein the elastic material is covered by the tab when the elastic material is in a relaxed condition.

8. The expandable shirt collar of claim 1, wherein the first end portion of the tab is hidden by a collar when the collar is disposed in a down position.

9. The expandable shirt collar of claim 1, wherein the elastic material may be stretched to 150% of a relaxed length without causing permanent deformation.

10. The expandable shirt collar of claim 1, wherein the elastic material is sandwiched between a first layer of the tab and a second layer of the tab.

11. An expandable shirt collar, comprising:

a collar band having a first end portion and a second end portion;

a button hole extending through the second end portion of the collar band;

a tab having a first end portion and a second end portion;

a button coupled to the second end portion of the tab; and an elastic material having a first end and a second end, the first end of the elastic material coupled to the first end portion of the collar band and the second end of the elastic material coupled to the first end portion of the tab wherein the elastic material is sandwiched between a first layer of the tab and a second layer of the tab.

12. The expandable shirt collar of claim 11, wherein the button is disposed on a front surface of the tab and the elastic material is disposed on a rear surface of the tab.

13. The expandable shirt collar of claim 11, wherein the elastic material is covered by the tab when the elastic material is in a relaxed condition.

14. The expandable shirt collar of claim 11, wherein the first end portion of the tab is hidden by a collar when the collar is disposed in a down position.

15. The expandable shirt collar of claim 11, wherein the button is vertically aligned with a linear array of buttons on the shirt body when the elastic material is in a relaxed condition.

16. An expandable shirt collar, comprising:

a collar band having a first end portion and a second end portion;

a button coupled to the collar band at the first end portion;

a tab having a first end portion and a second end portion;

a button hole extending through the first end portion of the tab wherein the button hole is vertically aligned with a linear array of buttons holes on the shirt body when an elastic material is in a relaxed condition; and the elastic material having a first end and a second end, the first end of the elastic material coupled to the second end portion of the collar band and the second end of the elastic material coupled to the second end portion of the tab.

17. The expandable shirt collar of claim 16, wherein a front surface of the tab and an outer surface of the collar band have an identical fabric.

18. The expandable shirt collar of claim 16, wherein a front surface of the tab and an outer surface of the collar band have a contrasting fabric.

19. The expandable shirt collar of claim 16, wherein the button hole is disposed on a front surface of the tab and the elastic material is disposed on a rear surface of the tab.

20. The expandable shirt collar of claim 16, wherein the button hole is disposed on a front surface of the tab and the elastic material is disposed between a front surface of the tab and a rear surface of the tab.

21. The expandable shirt collar of claim 16, wherein the collar band is disposed between a collar arid a shirt body.

22. The expandable shirt collar of claim 16, wherein the elastic material is covered by the tab when the elastic material is in a relaxed condition.

23. The expandable shirt collar of claim 16, wherein the first end portion of the tab is hidden by a collar when the collar is disposed in a down position.

24. The expandable shirt collar of claim 16, wherein the elastic material may be stretched to 150% of a relaxed length without causing permanent deformation.

25. The expandable shirt collar of claim 16, wherein the elastic material is sandwiched between a first layer and a second layer of the tab.

26. An expandable shirt collar, comprising:

a collar band having a first end portion and a second end portion;

a button coupled to the collar band at the first end portion;

a tab having a first end portion and a second end portion;

a button hole extending through the first end portion of the tab; and an elastic material having a first end and a second end, the first end of the elastic material coupled to the second end portion of the collar band and the second end of the elastic material coupled to the second end portion of the tab wherein the elastic material is sandwiched between a first layer and a second layer of the tab.

27. The expandable shirt collar of claim 26, wherein the button hole is disposed on a front surface of the tab and the elastic material is disposed on a rear surface of the tab.

28. The expandable shirt collar of claim 26, wherein the button hole is vertically aligned with a linear array of buttons on the shirt body when the elastic material is in a relaxed condition.

29. The expandable shirt collar of claim 26, wherein the elastic material is covered by the tab when the elastic material is in a relaxed condition.

30. The expandable shirt collar of claim 26, wherein the first end portion of the tab is hidden by a collar when the collar is disposed in a down position.

* * * * *

UNITED STATES PATENT AND TRADEMARK OFFICE

CERTIFICATE OF CORRECTION

PATENT NO. : 6,874,164 B2
DATED : April 5, 2005
INVENTOR(S) : Droppo et al.

It is certified that error appears in the above-identified patent and that said Letters Patent is hereby corrected as shown below:

Title page,
Item [73], Assignee, replace "Mississuaga" with -- Mississauga --.

Signed and Sealed this

Second Day of May, 2006

JON W. DUDAS
*Director of the United States Patent and Trademark Office*